US006065537A

United States Patent [19]

Evans et al.

[11] Patent Number: 6,065,537

[45] Date of Patent: May 23, 2000

[54] ROD GUIDE WITH BOTH HIGH ERODIBLE WEAR VOLUME AND BY-PASS AREA

[75] Inventors: Thomas E. Evans, Midland; H. Milton Hoff, Tomball; Randall Ray, Spring, all of Tex.

[73] Assignee: Flow Control Equipment, Inc., Tomball, Tex.

[21] Appl. No.: 09/023,595

[22] Filed: Feb. 13, 1998

[51] Int. Cl.[7] ..... E21B 17/10

[52] U.S. Cl. ..... 166/241.4; 166/241.2

[58] Field of Search ..... 166/241.1, 241.2, 166/241.3, 241.4, 241.5, 241.6, 175, 176

[56] References Cited

U.S. PATENT DOCUMENTS

| | | | |
|---|---|---|---|
| 586,001 | 7/1897 | Ballard . | |
| 1,600,577 | 9/1926 | Crickmer . | |
| 1,633,843 | 6/1927 | Bostic | 166/241.4 |
| 1,755,762 | 4/1930 | Armstrong et al. | 166/241.4 |
| 2,153,787 | 4/1939 | Anderson . | |
| 2,651,199 | 9/1953 | Collins et al. . | |
| 2,863,704 | 12/1958 | Hillman . | |
| 3,251,919 | 5/1966 | Ell . | |
| 3,912,012 | 10/1975 | Bush | 166/285 |
| 4,088,185 | 5/1978 | Carson . | |
| 4,997,039 | 3/1991 | Sable . | |
| 5,115,863 | 5/1992 | Olinger . | |
| 5,358,041 | 10/1994 | O'Hair . | |
| 5,492,174 | 2/1996 | O'Hair . | |

*Primary Examiner*—George Suchfield

*Attorney, Agent, or Firm*—Browning Bushman

[57] ABSTRACT

A rod guide fixedly molded around the shank of a sucker rod string with the rod guide including a radially inner non-erodible zone and a radially outer erodible zone. The non-erodible zone includes a radially inner substantially sleeve-shaped portion having an inner cylindrical surface for gripping engagement with the rod. A plurality of flow through channels are spaced outward of the substantially sleeve-shaped portion. Each flow through channel extends axially along the rod guide and has a maximum circumferential width greater than any gap in the radially outer surface of the erodible zone circumferentially aligned with and radially outward of the respective flow through channel. The radially outer surface of the erodible zone may have a cylindrical outer configuration, such that a radially outward substantially sleeve-shaped portion is provided for engagement with the tubing. The upper and lower surfaces of the rod guide may each be inclined such that the radially outer surface of the rod guide extends longitudinally in excess of the inner cylindrical surface of the sleeve-shaped portion and in engagement with the rod. A guided sucker rod includes an elongate rod having threaded end connectors for mating engagement with an adjoining sucker rod and one or more rod guides fixedly molded thereon. According to the method of the invention, left-side and right-side molds are created each including one or more elongate cavity creating member supported in a cantilevered fashion from a supporting end block. A plastic material is injected into the mold cavity, and the supporting end block is then moved longitudinally along the axis of the rod to remove the one or more channel performing members from the molded rod guide.

16 Claims, 6 Drawing Sheets

ROD GUIDE WITH BOTH HIGH ERODIBLE WEAR VOLUME AND BY-PASS AREA

FIELD OF THE INVENTION

The present invention relates to rod-pumped oil wells. More specifically, the invention relates to rod guides that centralize sucker rods within tubing and scrape paraffin from the interior wall of tubing. A rod guide having a high erodible wear volume according to this invention has its by-pass area flow channels placed predominately in the non-erodible portion of the guide.

BACKGROUND OF THE INVENTION

As crude oil is depleted from an underground formation, pressure in the formation decreases to the point that oil must be pumped to the surface. One of several methods for removing crude oil from an underground formation employs a pumpjack located on the surface. The pump-jack is connected via a sucker rod string to a downhole pump at the bottom of the producing oil well. The sucker rod string comprises many sucker rods, each rod connected end-to-end to another rod by a coupling. The entire rod string extends down into a tubing string that is commonly contained within a well casing. The exterior well casing and internal tubing string are permanently installed after drilling the well. The tubing string serves as a conduit for the fluid produced, and the driving force for this production is transmitted to the downhole pump via the sucker rod string positioned within the interior of the tubing string.

The sucker rod string commonly reciprocates inside the tubing string as a result of the upward and downward motion of the pump-jack to which the rod string is fastened. Cyclical upward and downward motion of the pump-jack is thus communicated to a downhole pump located at the lower end of the tubing string. In response, the pump forces the produced fluids collected at the bottom of the well up the tubing string to the surface. In other applications, a progressing cavity (PC) pump is used at the bottom of the well, and in these applications power to the pump is transmitted via a rotating sucker rod string.

The production fluid in the tubing string typically acts as a lubricant for the sucker rod string. Lubrication is derived from the fluid because it is commonly a mixture which includes crude oil, along with water and natural gas. Typically also included in the production fluids are dissolved and undissolved salts, gases and other formation minerals, such as sand. The recovered crude oil is commonly stored in a tank near the well until it is removed for refining. Natural gas is removed in a pipeline. Water is usually reinjected into the production formation or in a disposal well in another formation close to the production formation.

Due to deflections of both the tubing and the rod string, contact may occur between these components. Even though the lubricating bath of the production fluid is present in the tubing, wear is incurred on the rod string and tubing when contact is made. The rod couplings typically have the largest outer diameter of the various components of the rod string and therefore incur, and cause, the most wear. Produced fluids that flow in the rod and tubing annulus also cause wear in the form of abrasion and corrosion. Through time, all these wear factors may lead to parting of the rod string or to the development of holes in the tubing.

When a hole develops in the tubing, pressure is lost inside the tubing. Production will then be pumped into the annulus between the tubing and the casing rather than to the surface for collection and storage. When a sucker rod separates, when a rod coupling breaks, or when holes are created in the tubing, the sucker rods and/or tubing must be pulled from the well and inspected in detail for the extent and nature of the damage. Damaged rods and tubing must be replaced. The resultant down-time as well as the workovers are a great expense to the well owners. Therefore, methods and apparatus for reducing or eliminating costs associated with lost production of hydrocarbons, equipment replacements and workovers are of great benefit to the well owners.

A well known method of preventing wear to the rods and tubing is the use of rod guides, also known as centralizers and paraffin scrapers. In cases involving a reciprocating rod string, paraffin scrapers may also serve as centralizers to reduce wear, in addition to their implied purpose of removing paraffin from the walls of the tubing. Rod guides have a greater outer diameter than other parts of the rod string. As such, the guides are sacrificial and protective. Rod guides retard rod and tubing wear by incurring most of the wear that does occur.

On the average, six rod guides are normally attached at various locations on each sucker rod in the rod string, but as many as ten or more locations per rod or as few as one location per rod may be used. As such, the guides act as a sacrificial and protective buffer between the rod string and the tubing. Wear occurs to the guide as it protects the rod string and the tubing and results in a reduction of the protective thickness of the guide over time.

The wearing effects suffered by the rod guides will eventually cause the guides to have an outer diameter which will approach and become similar to the diameter of the couplings or parts of the rod string larger than the shank or body of the sucker rod. When this happens, the guide will no longer buffer the contact between the rod string and the tubing. The rod guides must then be replaced.

The general state of the art may be gathered by reference to a Rod Guide/Centralizer/Scraper Catalog published in 1997 by Flow Control Equipment (FCE) Inc. This catalog discusses rod guide material selection, paraffin scrapers; classic rod guide designs such as the standard and slant blade; high performance designs such as the NETB, Stealth and Double Plus; rotating rod guides for PC pumps such as the Spin-Thru and the PC Plus; and field installed guides (FIG's) such as the Lotus twist-on, NEPG, Lotus Rubber and Guardian polyguides. Also relevant to the general state of the art are patents to rod rotators and stabilizing bars.

Many of the design considerations applicable to any rod guide for either rotating or reciprocating sucker rod strings are discussed in a 1993 publication by Charles Hart entitled "Development of Rod Guides for Progressing Cavity (PC) Pumps", a 1995 publication by Randall G. Ray entitled "Determination of Rod Guide Erodible Wear Volume," and a 1993 publication by Milton Hoff entitled "Hydraulic Drag Forces on Rod Strings." The general concept of erodible wear volume EWV and specific formulations as "gross" and "net" EWV are used herein in accordance with the use in these publications. In particular, the portion of a rod guide between the largest outer diameter on the rod string (typically the coupling diameter) and the inner diameter of the tubing string is the volume of the guide which can prevent damaging metal-to-metal contact. This protective volume of the rod guide is referred to as EWV. EWV is an important indicator of rod guide performance. The amount of the rod guide outside the outer diameter of the sucker rod couplings is in general referred to a Gross Erodible Wear Volume or Gross EWV. A more refined concept, which is known as Net Erodible Wear Volume, is that amount of the rod guide material that will erode before the sucker rod coupling contacts the tubing. Net EWV is always less than Gross EWV in conventional rod guide designs when the rod string is reciprocated to drive the downhole pump. Even a reciprocating rod string should be slowly rotated during reciprocation to maximize the useful life of the rod guides. An underlying assumption of both of these EWV definitions is that the rod string is continuously rotated and that the rod guides wear evenly. Also, both definitions are based on the assumption that the rod string is in tension and not in compression. In some rod guide designs, the Gross and Net EWV may be almost the same but as they approach equality, then fluid bypass area decreases and the flow resistance or drag around the guide increases to unacceptable levels. It is the primary objective of the invention presented herein to generate more efficient rod guide designs which have Gross EWV approximating Net EWV without sacrificing the necessary bypass area and geometry necessary to achieve desired levels of flow resistance or drag.

For clarity and ease of discussion, a rod guide may be considered to have a radially inner non-erodible zone and a radially outward erodible zone. The boundary line between the two zones, namely the erodible and the non-erodible zones, will be considered to be the projected circumference of the largest outer dimensions of any component anticipated to be on the rod string in the operative region where the respective rod guide is located, which typically will be the rod couplings above and below the respective rod guide. "Operative region" means that section of the rod string close enough to the rod guide so that it may be expected that the rod guide will furnish some protection to the rod and its couplings. It is meant to exclude for definitional purposes couplings or other rod string elements which may be several rod lengths away from the rod guide and which would have no effect on the function or performance of the rod guide, and thus no effect on the guide dimensions at issue. As used herein, the terms "by-pass" and "flow through" are intended to be synonymous and interchangeable.

U.S. Pat. Nos. 586,001 and 1,600,577 are directed to a cleaner for oil well tubing and a paraffin scraper, respectively. Both disclosures have a gross similarity to some of the embodiments of the present invention but differ in intent, function, material and design. The same may also be said of U.S. Pat. No. 2,153,787, which is directed to the shrink fitting of a guard by extraction of a plasticizer. A flexible guide is taught in U.S. Pat. No. 2,651,199. A method of on-site molding of scrapers is disclosed in U.S. Pat. No. 3,251,919.

U.S. Pat. Nos. 2,863,704 and 4,997,039 disclose a combination rod guide and sand purging device. Several of the embodiments referred to in the materials cited above are disclosed in U.S. Pat. Nos. 4,088,185, 5,115,863 and 5,277,254. Recently disclosed variations of a rod guide are found in U.S. Pat. Nos. 5,358,041 and 5,492,174.

None of the above references are directed to the concept of the present invention as set forth and described below. The present invention overcomes the deficiencies of the prior art and achieves its objectives by maximizing EWV while providing adequate flow through paths in and around the guide to both prevent excessive hydraulic drag during movement of the guide with respect to the produced fluid and avoid the creation of an excessive pressure drop as the guide passes through the produced fluid during the downward motion of the sucker rod string.

SUMMARY OF THE INVENTION

The present invention is directed to maximizing the EWV of the guide while at the same time providing for sufficient flow through and around the guide to achieve the necessary or desired low pressure drop for the particular operating conditions in which the rod guide is used. As will be developed further below, the concept of the present invention calls for maximizing the ratios of the EWV to the total volume (TV) of a rod guide as well as the EWV to the flow resistance or drag of a rod guide. Ideally one of the best designs would have a cross section that resembles a bicycle wheel with as few spokes as possible.

The present invention utilizes plastic injection molding technology to secure the rod guide to the sucker rod while also preferably obtaining the formation of the necessary flow passages and open areas in or around the rod guide without resorting to drilling or other subsequent mechanical processes to obtain the desired flow passages.

A suitable rod guide according to the invention is secured to a rod string which is then placed in the tubing, with the guide functioning to centralize the rod string in the tubing while it passes through the tubing to the downhole pump and thereby minimizes wear between the rod string and the tubing. The rod guide has a radially inner non-erodible zone available for flow through and a radially outer erodible zone, as defined above.

An object of the present invention is to maximize the erodible wear volume of a rod guide while maintaining adequate flow through and around the guide to obtain a desired low pressure drop or drag across the guide.

It is an object of the present invention to provide an improved centralizing device which overcomes the deficiencies of the prior art between Gross and Net EWV and at the same time provides for high erodible wear volume consistent with the desired high flow through and low drag characteristics.

It is a feature of the present invention to provide for the molding of centralizers on the rod without having to resort to a drilling or similar operation to produce fluid flow paths in the molded guides resulting in the desired flow through for the guide with a high erodible wear volume.

It is a feature of the present invention to provide an improved and low cost rod guide which averts contact between the sucker rod string and the tubing of a producing oil well.

It is a further feature of the present invention to provide an improved rod guide that may clean mineral scale and paraffin deposits from the interior surface of the tubing when the guide is fixed to a reciprocating rod string.

It is another feature of this invention to achieve the above two features with a provision of an EWV which approaches the maximum obtainable in terms of Gros and Net EWV while providing a desired high flow through and low drag characteristics when the rod guide is in a typical application.

Still another feature of the invention is a rod guide molded around a rod intended to be placed within the tubing, with the rod guide having a high EWV and flow channels or by-pass areas predominately located in the non-erodible zone of the rod guide.

A significant advantage of the present invention is that the rod guide may achieve the above objects and features while the guide remains sturdy, compact, durable, simple, ecologically compatible, reliable, and inexpensive and easy to manufacture and maintain.

Other objects, features and advantages of the present invention, as well as a fuller understanding of this invention, may be had by referring to the following description and claims taken in conjunction with the accompanying drawings.

BRIEF DESCRIPTION OF THE DRAWINGS

In order to facilitate the understanding of the present invention, reference will now be made to the appended drawings of preferred embodiments of the present invention. The drawings should not be construed as limiting the invention, but are exemplary only.

DESCRIPTION OF PREFERRED EMBODIMENTS

The present invention is perhaps best understood by reviewing the first principles upon which the invention is based. As has been noted above, it is desired to maximize the EWV relative to the TV of a rod guide and simultaneously, at least to the extent desired or necessary, maximize the fluid flow channels through and/or around the rod guide to minimize the adverse affects of drag, turbulence or pressure drop across the guide.

The maximum EWV may be obtained by filling the entire area between the rod coupling outside diameter and the inner surface of the tubing with rod guide material like the rim on a bicycle wheel. By maintaining complete circumferential outer contact of the guide with the tubing inside diameter and also providing flow through the guide in the area between the outer diameter of the rod coupling and the outer diameter of the sucker rod should fluid flow through the guide is provided and erodible wear volume is maximized. As additional flow through holes in the guide are provided, usually in the preferred embodiments in a symmetrical pattern, flow is increased to the desired level with a desired low pressure drop and without decreasing the EWV. Preferably at least three through holes are thus provided in the guide. However, the structural integrity of the rod guide is reduced in the process. The present invention balances these factors in a unique manner to provide a moldable rod guide with a high EWV, a desired structural integrity, and flow through the guide to achieve a low pressure drop or low drag.

Figure 6:
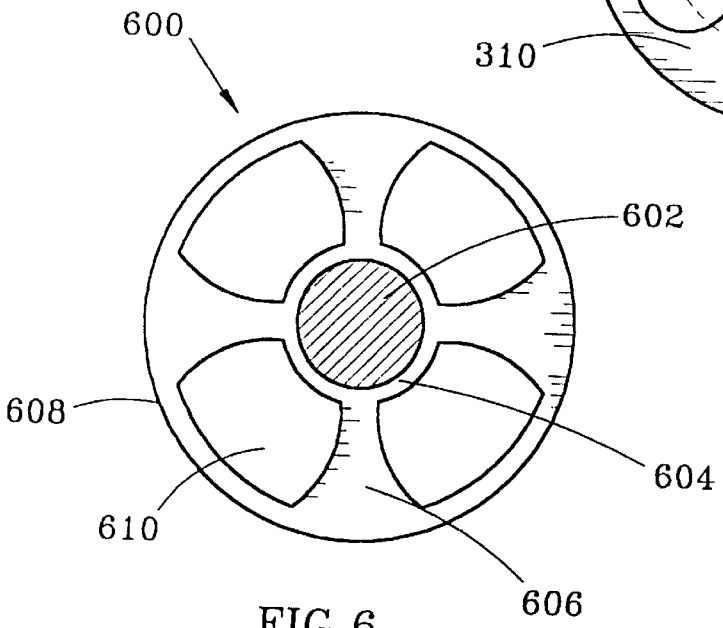
FIG. 6 is another embodiment of the present invention with an enlarged flow through area creating a rod guide having a generally Maltese cross configuration which can be achieved by changing the configuration and cross-section of the cavity rods.
Figure 8:
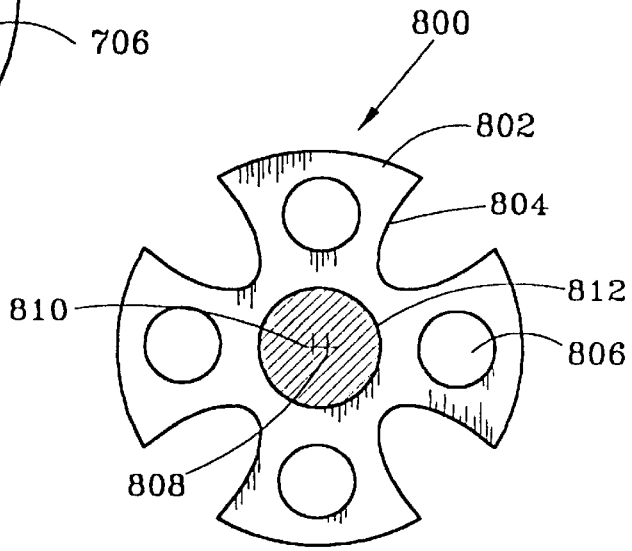
FIG. 8 is an end or top view of yet another embodiment of a rod guide in accordance with the present invention in which the generally Maltese cross shaped blades are provided with flow through cavities. The outer surface of the guide is off-set at its center of curvature from the rod center to provide an outer surface conforming to the internal curvature of the tubing. In all cases, the outside diameter of the guide is only slightly less than the inside diameter of the tubing.
Figure 9:
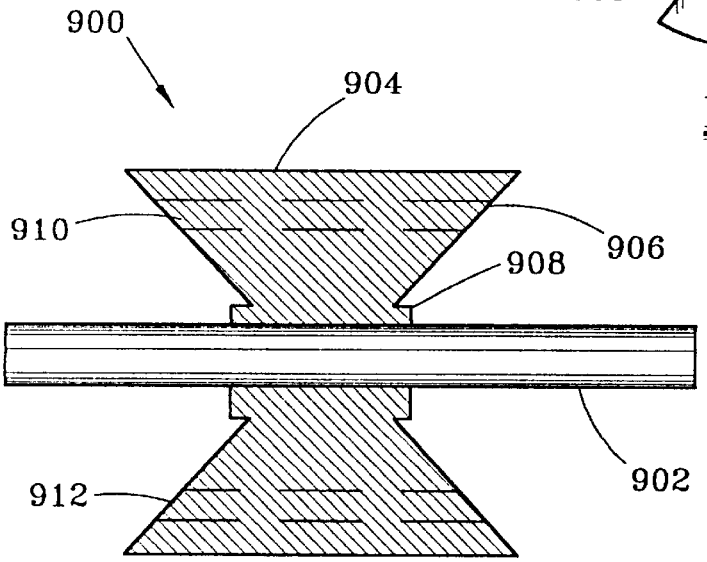
FIG. 9 is a side cross-sectional view of an embodiment of a rod guide in accordance with the present invention in which the outermost portions of the guide extend longitudinally parallel to the axis of the rod string and in excess of the portion of the guide molded to and in contact with the rod.
Figure 10:
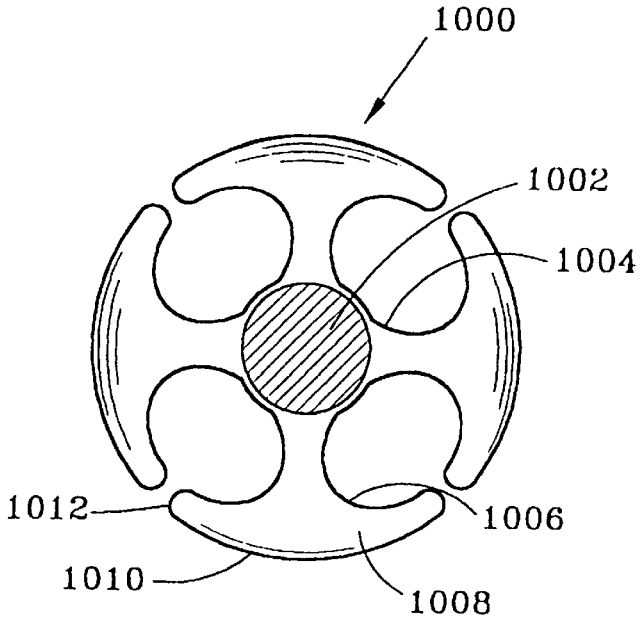
FIG. 10 is a top or end view of another embodiment of a rod guide of the present invention in which the space between the support arms of the rod guide has been enlarged to provide additional flow through capacity.

As holes in the rod guide are enlarged, a Maltese cross configuration such as shown in FIG. 6 may be formed by support arms which interconnect a radially inner substantially sleeve-shaped portion in gripping engagement with the rod with a radially outward sleeve-shaped portion forming a cylindrical outer surface of the rod guide essentially equal to the inside diameter of the tubing. The outer surface may be separated, as shown in FIG. 8 or FIG. 10, to reduce the EWV and provide for greater flow through capacity. Additional flow through capacity (by-pass area) may thus be obtained by increasing the flow through area in the erodible zone of the rod guide. Ideally, the erodible zone of the rod guide is maximized while still providing for high flow through capacity, and the resulting design has a sufficient structural integrity for a molded rod guide. To obtain these objectives, the relatively simple rod guide molding process becomes more complicated. A related concept involves the longitudinal expansion of the radially outer portions of the rod guide as shown in FIG. 9 and will be discussed in greater detail below.

Figure 1:
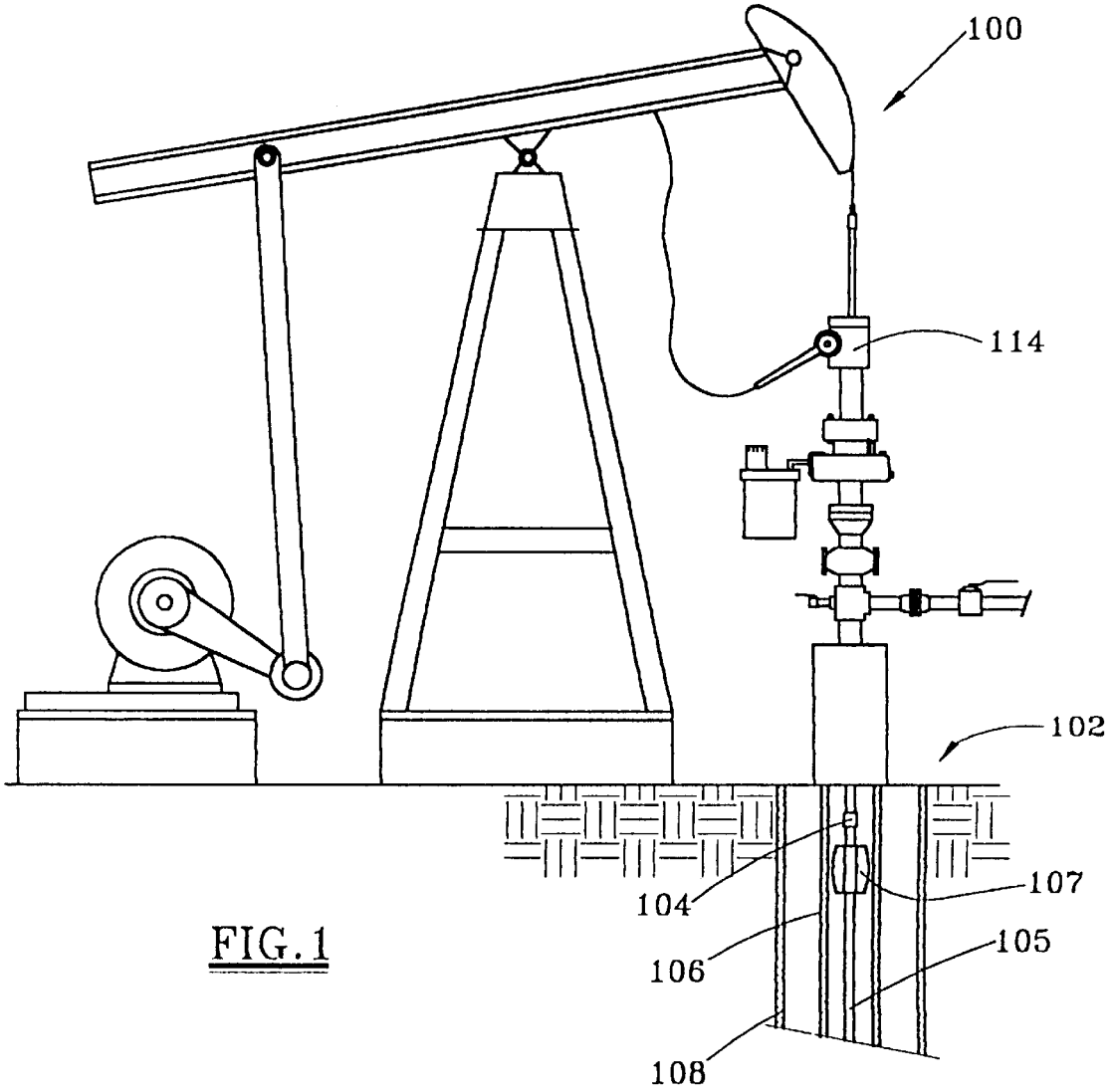
FIG. 1 is a side view of a typical well having a reciprocating rod string provided with rod guides of the present invention.

Referring to FIG. 1, a pumping apparatus 100 is shown for pumping fluids from a well 102 and through a string of tubing 106 disposed within well casing 108. Connected to the pumping apparatus 100 is a string of sucker rods 105 connected by coupling, such as typical coupling and pin connector means 104. The pumping apparatus as shown in FIG. 1 drives the rod string in a reciprocating manner to pump fluid to the surface through the well tubing. The rod string 105 may be rotated by a rod rotator 114, if desired, to distribute wear more evenly to both the rod guides 107 and the sucker rods 105.

When the pumping apparatus 100 is on the down stroke of its reciprocating action, the string of rods 105 move axially within the tubing 106 to operate the downhole pump (not shown). A plurality of rod guides 107 of the present invention are fixedly engaged around the sucker rods 105 at selected locations throughout the length of the rod string 105. During this reciprocating movement of the string of sucker rods 105, the well fluids are caused to flow upwardly in the tubing 106 on the upstroke and the rod guides 107 fall through the fluid on the downstroke.

Figure 2:
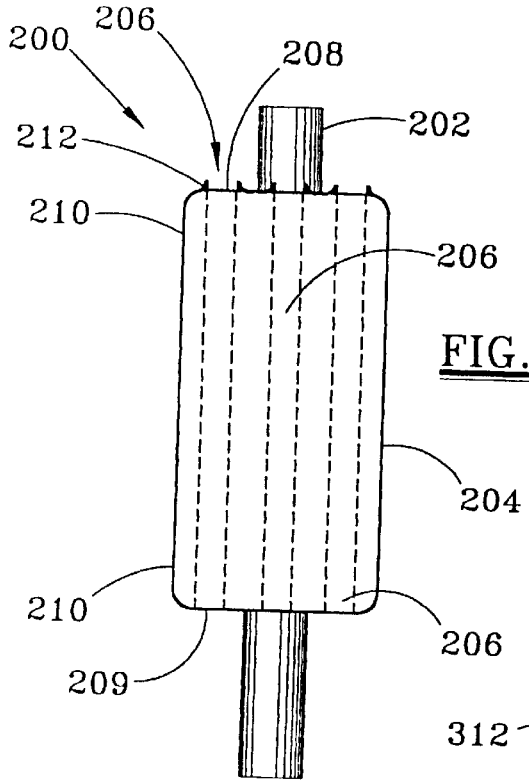
FIG. 2 is a side view of one embodiment of a rod guide of the present invention.

FIG. 2 shows a rod guide 200 molded to a rod 202. The generally cylindrical rod guide body 204 has a circumferential outer surface 210 and is provided with a plurality of cylindrical holes 206 which end at the top and bottom surfaces 208 and 209 of the rod guide, respectively. As a result of the formation of the holes by cantilevered cavity rods as discussed subsequently, the holes 206 may have excess nipple material 212 at one end, as will be made more apparent by considering the molding process described below. This excess material 212 is shown exaggerated in FIG. 2 for clarity.

Figure 3:
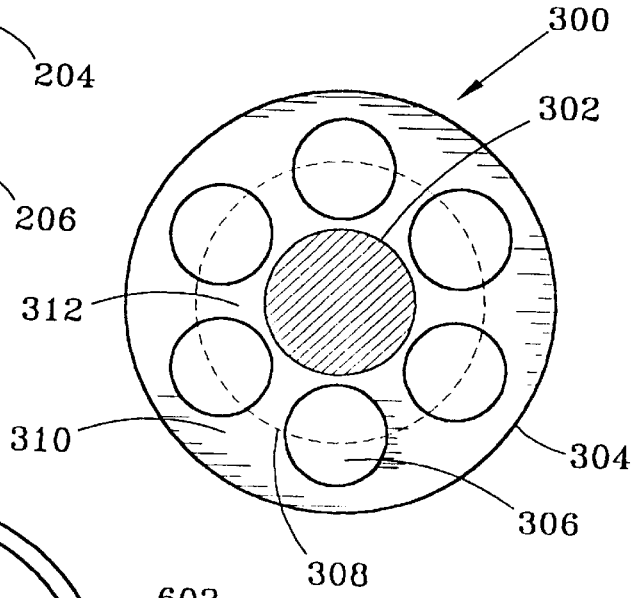
FIG. 3 is a top or end view of the rod guide shown in FIG. 2.

When seen from a top or end view, the holes 206 appear as holes 306 in FIG. 3 wherein the rod guide 300 is molded about rod 302 and has an outer circumferential surface 304 sized for initial contact (or approximately so) with the internal surface with the tubing (not shown). The outer surface of the couplings in the operative region of the rod 302 is shown in dashed lines and represents the circumferential boundary 308 which defines the inner limit of the erodible wear volume (EWV) 310 which extends to the outer surface 304. The area between the boundary line 308 and the rod 302 thus defines the non-erodible zone of the rod guide. In general, the rod guide may consist of a radially inner non-erodible zone and a radially outward erodible zone. As noted above, the boundary line between the two zones, the erodible and the non-erodible zone, is the projected circumference of the largest outer dimension of any component anticipated to be on the rod string in the operative region of the rod guide. The boundary line which in this example is equal to the outside diameter of the nearest rod coupling is thus the dashed line 308 shown in FIG. 3. The erodible zone contains that material in the region between the boundary line 308 and the outer surface of the rod guide 304 which is only slightly less than the inner diameter of the tubing string. The erodible zone includes that volume of material in the rod guide which may be eroded in use before a component on the rod in the operative region of the rod guide contacts the tubing. It is desired for the rod guide to have the maximum amount of material in the erodible zone and thereby to have the maximum EWV for a given length of guide. At the same time, it is desired to provide for adequate flow through capacity (by-pass area) through the rod guide by providing flow channels, holes 306, through the rod guide. These holes will preferably be located predominately in the non-erodible zone of the rod guide.

As the size of the flow through holes is enlarged to provide for a greater volume of fluid flow through the rod guide without increasing drag and pressure drop, a configuration such as shown in FIG. 6 may result, wherein a rod guide 600 is molded on rod 602. The guide 600 is held in place on the rod by a radially inner substantially cylindrically shaped portion 604 of the non-erodible zone which surrounds the rod 602 and in gripping engagement therewith as a result of the molding process. The enlarged flow through holes 610 form a plurality of support arms 606 in the form of a Maltese cross which connect the radially inner portion 604 with a radially outer cylindrical surface 608 of the crodible zone for complete circumferential contact with the tubing (not shown).

Figure 7:
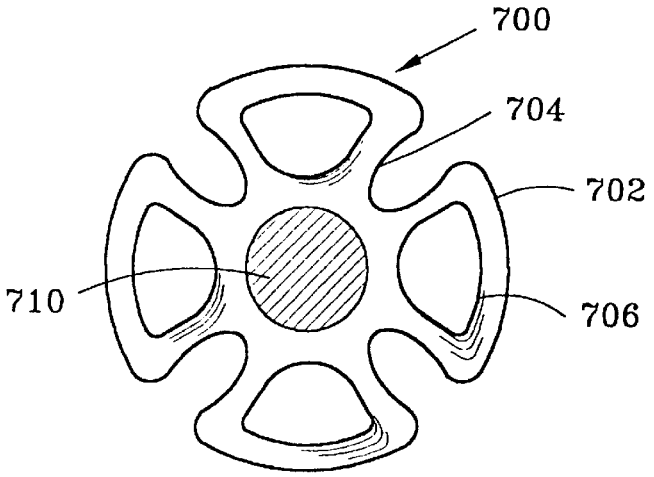
FIG. 7 is an end or top view of another embodiment of the present invention in which the rod guide has expanded internal flow through cavities as well as external flow channels, both of which can be obtained by changing the configuration and cross-section of the cavity rods and mold geometry.

As shown in FIG. 7, a rod guide 700 has support arms which include indentations defined by 704 and erodible wear surfaces 702. Flow through cavities 706 are spaced circumferentially about rod 710, and additional flow capacity is provided by the circumferential spacing between the indentations 704. A similar expansion of the flow through area may result in a Maltese cross of the form as shown in FIG. 8, in which a rod guide 800 has an expanded flow through area bounded by surfaces 804 and flow through holes 806. The outer linear surface 802 has a diameter slightly smaller than the inside diameter of the tubing (not shown). The center 808 of the curved outer surface 802 coincides substantially with the center 110 of the sucker rod 812.

In FIG. 10, a rod guide 1000 is molded about rod 1002 and has flow through areas bounded by 1004 and 1006 which form EWV 1008 bounded on the outside by wear surface 1010. Support arm extensions 1012 may substantially touch to form a substantially complete circumference of wear surface of the EWV to contact the tubing.

Figure 4:
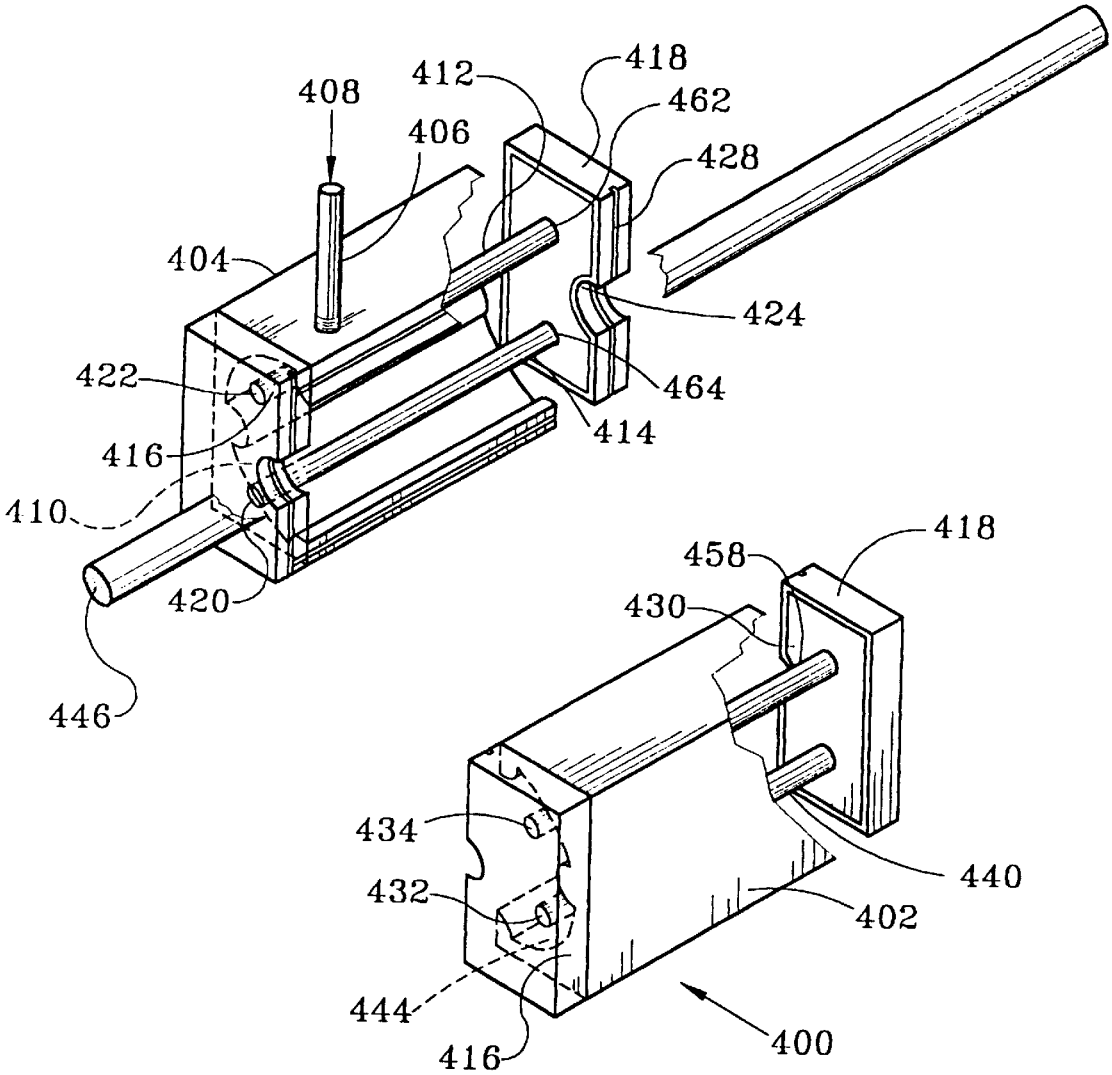
FIG. 4 is an isometric view of the molds for the moving and stationary platens of a molding system used to mold the present invention on a rod. The front right of each side mold supports the cavity rods in a cantilevered fashion. These rods are withdrawn before the mold is opened. The upper side mold is mounted to the stationary platen and is shown positioned adjacent the rod for a molding operation. The lower side mold is mounted on the moving platen and away from the rod. In this view, the moving platen is retracted and the molds are in the open position. The cavity rods are shown partially inserted for clarity.

The molding operations according to the present invention may be of the type described below in connection with FIGS. 4 and 5. The details of injection molding as employed in the art are well known and, except as expressly noted herein, do not constitute a part of the present invention. A description of the operation and construction of injection molding equipment may be found in a 1962 publication *Manufacturing Processes* by S.E. Ursunoff, American Technical Society, beginning at page 56. A description of the application of molding processes in connection with molded plastic rod guides, centralizers, scrapers and the like may also be found in U.S. Pat. Nos. 3,251,919 and 4,088,185.

Among the materials suitable for use in accordance with the present invention are polyphenylene sulfide, polyphthalamide, polyamide (nylon), polyethylene, polypropylene, polycarbonate and polyester. All these thermoplastic resins may also be used with glass, arimide fibers and mineral fillers. Ultra-high molecular weight polyethylene may be employed in circumstances which do not involve injection molding. In general, plastics having suitable shrinkage properties and tensile strengths may be employed if not too brittle on molding, if their abrasion and wear characteristics are satisfactory, and if they can withstand the wide range of tempera tures an d c orrosive conditions found in oil well operations. A more extensive listing of suitable materials may be found in U.S. Pat. No. 4,088,185.

It is desirable but not essential according to the present invention to provide the flow through holes in the rod guide without resort to drilling or similar means. The present invention includes the process herein describe of providing such flow through holes as a part of the molding process. As shown in FIG. 4, a two part mold 400 is created or provided consisting of left-side and right-side molds 402 and 404 with a suitably shaped rod guide cavity consisting of left-side and right-side portions 444 and 410, respectively. The cavity in each half of the mold may be filled with plastic material 408 injected into the mold through tube 406. Cantilevered within the cavity may be one or more rods, such as, for example, rods 412 , 414 , 440 and 458 . Th ese rods may each b e cantilevered in the mold cavity 410 and supported by one end of a respective supporting end block member 418. Each mold half also includes an axially opposing end block member 416. The connection face between the rods 412 an d 414 with the mold half 404 i s shown as 462 and 46 4 in FIG. 4.

The two mold halves 402 and 404 are radially closed about the sucker rod 446 and the end blocks 418 are moved axially with respect to mold portions 402 and 404 to a closed or mold position to provide a totally enclosed cavity into which the plastic material 408 is injected through tubing 406. Each mold half includes end blocks with substantially semi-circular ports 424 the rein for receiving the sucker rod 446 when the mold halves are closed. A suitable face seal 428 is provided on the radially inward face of one or both blocks 416, 418 for sealing with the radially opposing block when the mold is closed. Similarly, a seal 430 is provided for sealing e ngagement between the end blocks 418 and the r espective primary left side and right side mold 402 and 404 when the mold is closed. The cantilevered rods 412, 414, 440 and 458, w hich may be of any of many shapes to provide flow through holes of the shape or shapes desired, are further supported in the closed position by insertion of the free or cant levered end of each rod into shallow pockets 420, 422, 432, 434 in the respective opposing end blocks 416 of mold ports 402 and 404 to support the free ends of the rods.

Figure 5:
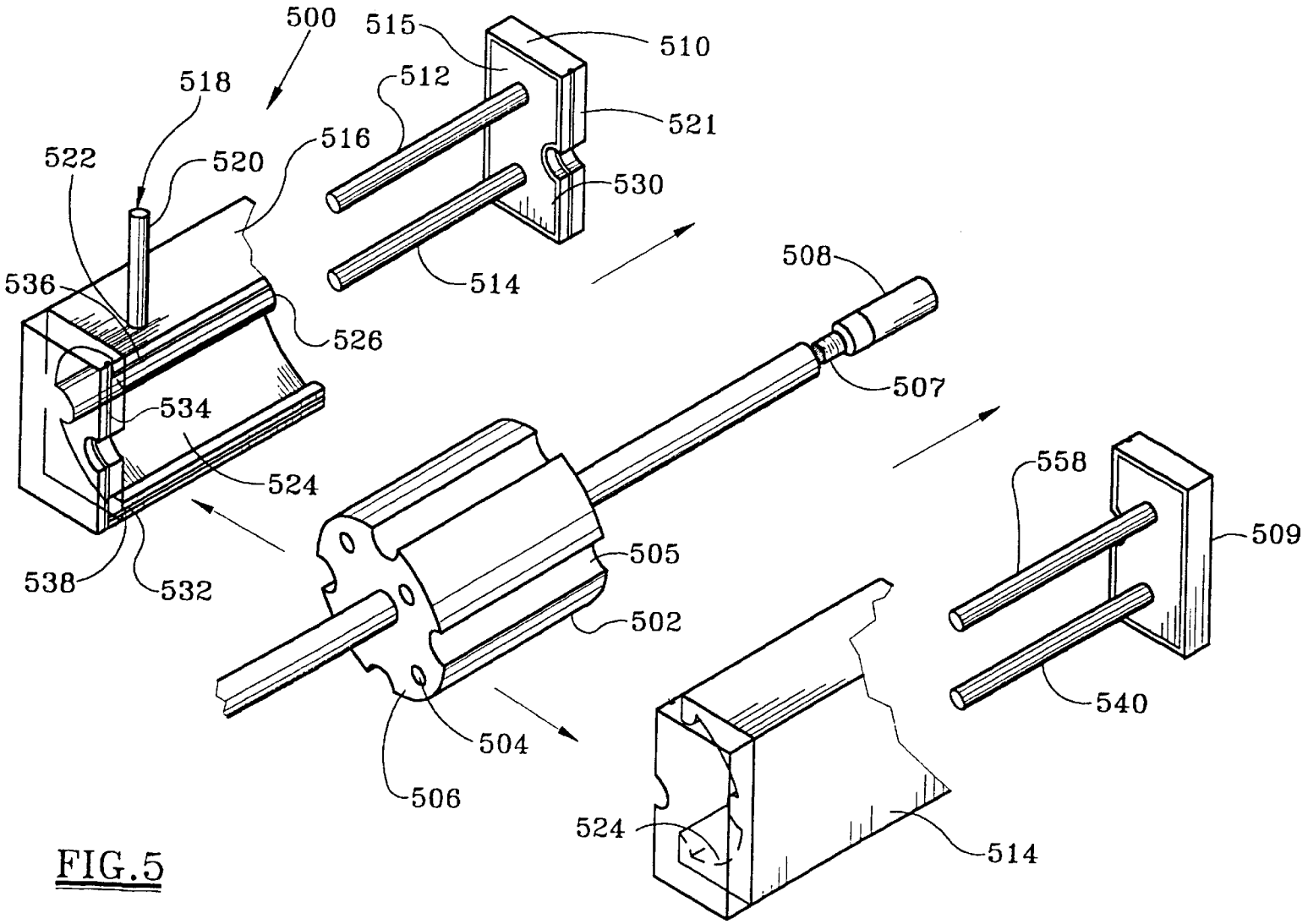
FIG. 5 is an isometric view of the molding apparatus in accordance with the present invention after the separation of the mold from the rod following the molding of a guide on the rod.

As shown in FIG. 5, after the plastic material 518 has been injected through conduit 520 and through the port 522 in the mold half 516 and into the rod guide cavity 524 formed by the mold halves 515 and 516 which makes up the mold 500, a rod guide 502 having a desired EWV and outer surface 506 will have been formed about rod 508. Rod guide 502 contains axially extending flow through holes 504 formed by the cantilevered rod members 412, 414, 440 and 458. Also, a plurality of outer flow paths 505 are formed about the outer periphery of the guide 502, with these axially extending flow paths 505 being formed by the respective generally semi-cylindrical radially inwardly projections 526 provided in each mold half 514 and 516. The end blocks 509 and 510 are moved longitudinally along the axis of the rod 508, thereby breaking the seals 530 and removing the rods from the holes 504. When end blocks 509 and 510 carrying cantilevered rods 412, 414, 440 and 458 are clear of the guide 502, the mold halves which are attached to the moving and stationary platens of the injection molding machine may then be separated. The substantially sideways U-shaped seal 532 comprising end seal 534 and top and bottom legs 536 and 538 will thus be broken during this separation process. Similarly, the face 521 on the end block 510 may be radially separated from the opposing face on the block 509. In this manner, flow through holes 504 of any desired shape or size may be provided in a single molding operation. The rods 512, 514, 540 and 558 are cantilevered and fixed to end blocks 509 and 510 and sufficient spacing is provided during the molding operation for the blocks 509 and 510 with their supported rods to clear the molded work piece formed on the sucker rod 508. In the above fashion, it is possible to provide flow through holes in various pieces of any molded guide in any size or shape.

In operation, the mold halves and end blocks are closed about the rod and the plastic material is injection molded around the rod. After the guide is formed, the end blocks with cantilevered rods are moved longitudinally along the axis of the rod until clear of the molded workpiece. The major mold halves may then be opened (moved radially with respect to the rod 508) and separated from the molded guide. Those skilled in the art will appreciate that the sucker rods 408 on which the rod guides are molded conventionally have threaded end members 507 as shown in FIG. 5. During the rod guide molding process, these threaded connections 507 are normally broken and the rod guides are molded at preselected axial locations along the length of a single sucker rod. After the rod guide molding operation, the connections 507 on the rods 508 may be threadedly coupled to comprise a rod guide string which is reciprocated in the well.

Figure 11:
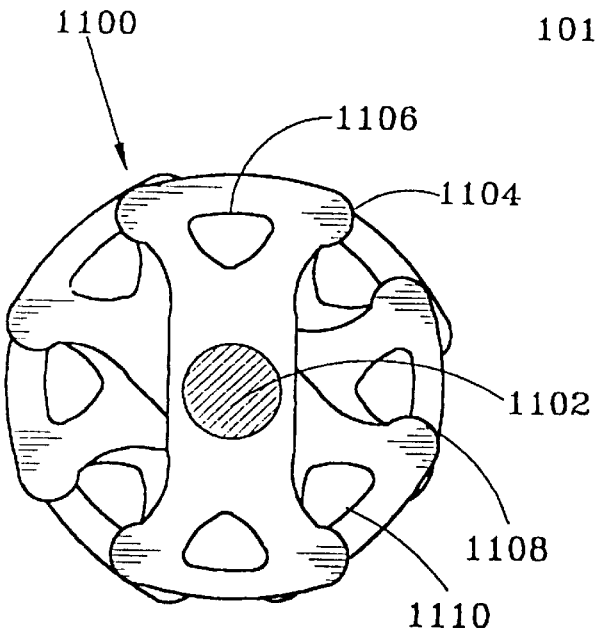
FIG. 11 is an end or top view of an embodiment of the present invention in which four or more of the two bladed rod guides have been molded on the rod, with each successive guide indexed 45 degrees with respect to the next adjacent rod guide in a nesting approach to concentrate the EWV, which is undesirably low for a single two bladed guide alone but increasingly effective as more two bladed guides are indexed and molded closely together.

In a similar fashion to that described above, the dog bone configuration of the centralizer or guide 1100 of FIG. 11 may be molded about rod 1102. Such guides 1100 may be indexed with respect to each other as shown in FIG. 11 to form a nest of rod guides or a helical array of guides effectively providing complete 360 degree coverage and wear contact area with the tubing. As shown in FIG. 11, guides 1100 may be molded about rod 1102 in an indexed fashion of, for example, 45 degrees from the next adjacent guide. The flared area 1104, 1108, etc. may be as extensive as desired consistent with the needed flow through characteristics to provide the desired wear surface and EWV. Holes for the desired flow through 1106 and 1110 may be provided by the molding techniques described herein.

Figure 12:
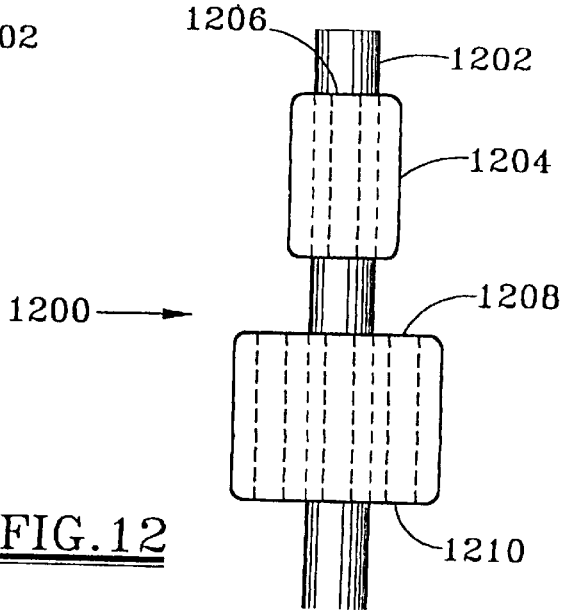
FIG. 12 is a side view of a portion of the array shown in FIG. 11, illustrates only two of the two blade rod guides indexed at 90°.

Two of the indexed guides of FIG. 11 are shown in FIG. 12 wherein the array 1200 of guides 1204, and 1208 with the wear surfaces as described above are molded about rod 1202 in an indexed manner of 90 degrees with respect to the next adjacent guide. If desired, flow through holes 1206 and 1210 may be provided by means of the molding process described above.

As shown in FIG. 9, these same techniques may also be applied to mold a guide such as 900 around rod 902 with material in contact with the rod 908 and gripping the rod. The rod guide includes extended longitudinal wings 906 to provide extended wear surface 904 and extended EWV. A multiplicity of flow through holes 910 and 912, for example, may be provided to permit the necessary and desired flow through capacity. The extended longitudinal wings are a further example of a fundamental concept of the present invention in that such a configuration inherently provides for extra outer material for EWV relating to the total volume of the guide and still maintain the necessary flow through capacity in the non-erodible zone of the rod guide.

In most if not all of the configurations shown herein, the circumferential extent of any of the separated arms of the rod guide may be expanded to any extent desired consistent with the desired flow through characteristics or the need for by-pass area up to and including full circumferential contact with the tubing.

While it is preferred to form the flow through channels as described herein, it is within the scope of the claims below describing the present invention to drill some or all of the holes, if desired. The cantilevered rods referred to above may also be suspended by other material supports within the mold cavity.

Further embodiments such as the use of a spiral or helical vane may be employed in accordance with the present invention. In such an embodiment, the EWV may be controlled as a function of the pitch and number of leads provided. The flow through capacity may be controlled by the number and position of the holes in the erodible and the non-erodible zones of the rod guide.

It will be apparent to one of ordinary skill in the art that the present invention may be modified to employ the principles taught within the scope of the present invention. Various changes and modifications may be effected in the illustrated embodiment of the present invention without departing from the scope and spirit of the invention defined in the appended claims. The embodiments shown and described above are exemplary. Various modifications can be made in the construction, material, arrangement, and operation, and still be within the scope of the invention. The limits of the invention and the bounds of the patent protection are measured by and defined in the following claims.

What is claimed is:

1. A sucker rod guide fixedly molded around a sucker rod for being placed along a sucker rod string for positioning within tubing, the sucker rod guide consisting of a radially inner non-erodible zone and a radially outer erodible zone, a boundary line between the erodible and the non-erodible zones being a projected circumference of a largest outer dimension of components on the rod string in an operative region of the sucker rod string on which the rod guide is fixed, the erodible zone being a region between the boundary line and an inner diameter of the tubing string and the non-erodible zone being the region between the boundary line and an outer diameter of a shank of the sucker rod string on which the sucker rod guide is fixed, the erodible zone having a corresponding volume of sucker rod guide material which may be eroded during movement of the sucker rod guide with respect to the tubing before components on the sucker rod string contact the tubing, the sucker rod guide further comprising:

the non-erodible zone including a radially inner substantially sleeve-shaped portion having an inner cylindrical surface for gripping engagement with the sucker rod; and a plurality of flow through channels spaced radially outward of the substantially sleeve-shaped portion, each flow through channel extending axially along the sucker rod guide and having a maximum circumferential width greater than any gap in a radially outer surface of the erodible zone of the sucker rod guide circumferentially aligned with and radially outward of the respective flow through channel.

2. The rod guide as defined in claim 1, wherein the radially outer surface of the erodible zone of the rod guide has a cylindrical outer configuration, such that the erodible zone of the rod guide has a radially outward substantially sleeve-shaped portion containing the outer surface of the rod guide.

3. The rod guide as defined in claim 1, further comprising:

a plurality of support arms each extending radially between the radially inner sleeve-shaped shaped portion of the non-erodible zone and the radially outer surface of the erodible zone, each support arm having a minimum circumferential width and a radially outward portion having a circumferential width greater than the minimum circumferential width.

4. The rod guide as defined in claim 3, wherein the plurality of support arms include two radially opposing arms forming a dumbbell configuration.

5. The rod guide as defined in claim 1, wherein the radially outer surface of the erodible zone extends longitudinally along the axis of the rod in excess of the inner cylindrical surface of the radially inner sleeve-shaped portion in engagement with the rod.

6. The rod guide as defined in claim 5, further comprising:

an upper surface of the rod guide being inclined upwardly in a direction extending radially outward from the radially inner sleeve-shaped portion to the outer surface of the guide.

7. The rod guide as defined in claim 6, further comprising:

a lower surface of the rod guide being inclining downwardly in a direction extending radially outward from the radially inner sleeve-shaped portion to the outer surface of the guide.

8. The rod guide as defined in claim 1, wherein a majority portion of each of the plurality of flow through channels resides in the erodible zone of the rod guide.

9. The rod guide as defined in claim 1, wherein the plurality of flow through channels comprise at least three flow through channels circumferentially spaced about the rod guide.

10. The rod guide as defined in claim 1, wherein the outer surface of the rod guide circumferentially extends along a combined circumference of at least 180°.

11. A guided sucker rod for being placed along a sucker rod string for positioning within tubing, the guided sucker rod including an elongate sucker rod having threaded end connectors at each end for mating engagement with an adjoining sucker rod and one or more sucker rod guides fixedly molded on a shank portion of the elongate sucker rod, each sucker rod guide consisting of a radially inner non-erodible zone and a radially outer erodible zone, a boundary line between the erodible and the non-erodible zones being a projected circumference of a largest outer dimension of the threaded end connectors at opposing ends of the elongate sucker rod on which the sucker rod guide is fixed, the erodible zone of each sucker rod guide having a corresponding volume of rod guide material which may be eroded during movement of the sucker rod guide with respect to the tubing before components on the sucker rod string contact the tubing, the non-erodible zone of each sucker rod guide including a radially inner substantially sleeve-shaped portion having an inner cylindrical surface for gripping engagement with the sucker rod, and each sucker rod guide having a plurality of flow through channels spaced radially outward of the substantially sleeve-shaped portion, each flow through channel extending axially along the sucker rod guide and having a maximum circumferential width greater than any gap in a radially outer surface of the erodible zone of the sucker rod guide circumferentially aligned with and radially outward of the respective flow through channel.

12. The guided sucker rod as defined in claim 11, wherein the radially outer surface of the erodible zone of each of the one or more rod guides has a cylindrical outer configuration, such that the erodible zone of each rod guide has a radially outward substantially sleeve-shaped portion containing the outer surface of each rod guide.

13. The guided sucker rod as defined in claim 11, further comprising:

each of the one or more rod guides including a plurality of support arms each extending radially between the radially inner sleeve-shaped portion of the non-erodible zone and the radially outer surface of the erodible zone, each support arm having a minimum circumferential width and a radially outward portion having a circumferential width greater than the minimum circumferential width.

14. The guided sucker rod as defined in claim 11, wherein the radially outer surface of the erodible zone of each of the one or more rod guides extends longitudinally along the axis of the rod in excess of the inner cylindrical surface of the radially inner sleeve-shaped portion in engagement with the rod.

15. The guided sucker rod as defined in claim 14, further comprising:

an upper surface of each of the one or more rod guides being inclined upwardly in a direction extending radially outward from the radially inner sleeve-shaped portion to the outer surface of the guide; and a lower surface of each of the one or more rod guides being inclining downwardly in a direction extending radially outward from the radially inner sleeve-shaped portion to the outer surface of the guide.

16. The guided sucker rod as defined in claim 11, wherein each of the one or more rod guides includes at least three flow through channels circumferentially spaced about the rod guide.

* * * * *